United States Patent [19]

Siemers et al.

[11] Patent Number: 4,726,962

[45] Date of Patent: Feb. 23, 1988

[54] ALTERNATING SEGMENT RING STRUCTURE

[75] Inventors: Paul A. Siemers, Clifton Park; Robert W. Kopp, Ballston Lake; Melvin R. Jackson, Schenectady, all of N.Y.

[73] Assignee: General Electric Company, Schenectady, N.Y.

[21] Appl. No.: 849,993

[22] Filed: Apr. 10, 1986

Related U.S. Application Data

[63] Continuation of Ser. No. 653,107, Sep. 21, 1984, Pat. No. 4,657,823.

[51] Int. Cl.[4] ..... B05D 1/08

[52] U.S. Cl. ..... 427/34; 427/130; 427/132; 427/423

[58] Field of Search ..... 427/34, 127, 130, 132, 427/423; 310/153, 156

[56] References Cited

U.S. PATENT DOCUMENTS

| | | | |
|---|---|---|---|
| 2,140,534 | 12/1938 | Mahoney | 428/928 |
| 2,519,918 | 8/1950 | Merrill | 428/937 |
| 2,767,464 | 10/1956 | Nack et al. | 428/679 |
| 3,247,579 | 4/1966 | Cattermole et al. | 427/34 |
| 3,668,951 | 6/1972 | Talmage | 428/610 |
| 3,777,367 | 12/1973 | Kalagidis | 427/34 |
| 3,828,212 | 8/1974 | Harkness et al. | 310/156 |
| 3,843,334 | 10/1974 | Cromwell | 427/34 |
| 4,117,360 | 9/1978 | Richter | 310/156 |
| 4,182,027 | 1/1980 | Benezech | 310/153 |
| 4,227,105 | 10/1980 | Kumakura | 310/153 |
| 4,529,615 | 7/1985 | Zverina et al. | 427/34 |

*Primary Examiner*—John H. Newsome

*Attorney, Agent, or Firm*—Paul E. Rochford; James C. Davis, Jr.; Paul R. Webb, II

[57] ABSTRACT

A ring is formed having alternating segments of ferromagnetic and paramagnetic materials. The ring is formed by first providing an annular ring of a high strength magnetic steel. Teeth are formed on the outer surface of the ring by forming troughs of the ferromagnetic material. Low pressure plasma deposition is used to fill in the troughs with a high strength paramagnetic material. The excess steel and excess plasma deposited material is removed to leave the finished ring of alternating segments of ferromagnetic and paramagnetic material.

6 Claims, 6 Drawing Figures

ALTERNATING SEGMENT RING STRUCTURE

This application is a division of application Ser. No. 653,107, filed Sept. 21, 1984, now U.S. Pat. No. 4,657,823.

BACKGROUND OF THE INVENTION

The present invention relates generally to the fabrication of a ring structure by low pressure plasma deposition processing. More specifically, it relates to the formation of a ring having alternating ferromagnetic and paramagnetic segments suitable for use in an aircraft generator.

Structures of ring configuration which have alternating segments of ferromagnetic and paramagnetic materials have been made heretofore. The use of such structures is in an aircraft engine generator. The magnet segments of the ring aid in supplying a needed magnetic field. The ring structure itself holds alternating permanent magnet wedges and filler material wedges in place within the ring and is mounted in the aircraft for rotation to bring the sequence of magnetic fields to a designated location as the ring is rotated.

In some designs of aircraft, permanent magnet aircraft generators require a segmented shrink ring which is comprised of alternating ferromagnetic and paramagnetic materials. The ring is mounted to the rotor for rotation with the rotor and to supply the magnetic flux as required in operation of the engine. Because of the high rotational speeds, the segmented shrink ring is required to reliably operate at stress levels of 130 ksi. This requirement places severe stress on the bonds between the ring segments. Presently, and prior art practice, these rings are fabricated by machining each of the segments and by then electron beam welding the individual segments together to form the ring of alternating ferromagnetic and paramagnetic segments. The welded structure is then given a finish machining and the alternating permanent magnet and filler material wedges are mounted in the ring to prepare it for mounting as a rotor of the aircraft.

This prior art fabrication method results in a successful segmented shrink ring but one which is very costly.

BRIEF DESCRIPTION OF THE INVENTION

It is accordingly one object of the present invention to provide a ring structure having alternate segments of ferromagnetic and paramagnetic materials.

Another object is to provide a method of forming a shrink ring having alternate segments of metals having different characteristics.

Another object is to provide an improved shrink ring having alternate segments of ferromagnetic and paramagnetic materials.

Other objects and advantages of the present invention will be in part pointed out and in part apparent from the descripion which follows.

In one of its broader aspects, objects of the present invention can be achieved by providing a ring of highly ferromagnetic material and forming external teeth on the ring. Low pressure plasma deposition is then employed to fill in the zones between the teeth on the outer surface of the ring. The inner portion of the ring is then machined away to leave only the teeth and the plasma deposited material extending between the teeth. The external surface of the ring is machined to remove excess plasma deposited material and to give a finished smooth ring product.

BRIEF DESCRIPTION OF THE DRAWINGS

The description which follows will be better understood by reference to the accompanying drawings in which.

DETAILED DESCRIPTION OF THE INVENTION

It has been discovered that a segmented shrink ring for the retention of a set of permanent magnet wedges and alternating filler material wedges in an aircraft engine generator can be fabricated using a low pressure plasma deposition process.

Figure 1:
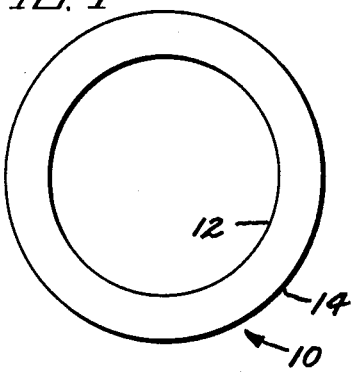
FIG. 1 is an elevational view of a ring of highly ferromagnetic material.

To initiate this fabrication, a mandrel of a high strength magnetic steel is first provided. Such a mandrel 10 is illustrated in FIG. 1. It has dimensions which are slightly smaller in the internal diameter 12 than the ring which is to be formed. It also has the external diameter 14 which is close to the outer dimension of the ring which is to be formed.

The first step which is taken in forming the structure of the present invention is to machine the high strength magnetic steel to form alternating teeth, illustrated by teeth 16, 18 and 20 around the perimeter of ring 10. The purpose of machining the teeth such as 16, 18 and 20 is to permit the space between the teeth to be filled by the low pressure plasma deposition process.

Figure 2:
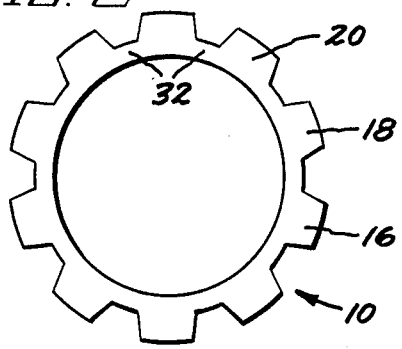
FIG. 2 is an elevation of the ring of FIG. 1 with segments removed from the outer surface to form a set of external teeth.

Steels which are suitable for use in forming the structure of FIG. 2 include such steels as the 4340 steel, the H-13 tool steel, or the M-2 tool steel. These steels are ferromagnetic.

Figure 3:
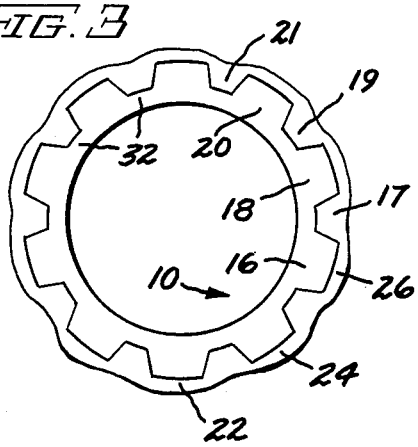
FIG. 3 is the ring of FIG. 2 to which an outer layer of plasma deposited material has been formed.

Referring next to FIG. 3, the ring 10, having the teeth such as 16, 18 and 20 is made to serve as the collection surface for the deposit of a suitable high strength paramagnetic material as sprayed by the low pressure plasma deposition process. In serving as a receiving surface, the ring 10 receives a deposit of the paramagnetic material both in the trough such as 17, 19 and 21 and also receives deposits overlying the teeth 16, 18 and 20 at the outer rings, respectively 22, 24 and 26. The paramagnetic material deposited by the plasma process must be strong enough to with stand 130 ksi stresses. Superalloys are such paramagnetic materials when produced by low pressure plasma deposition. A specific superalloy designated as IN100 was employed in filling the troughs as illustrated in FIG. 3. The nominal composition of IN100 is as follows: 15 parts cobalt; 10 parts chromium; 5.5 parts aluminum; 5 parts titanium; 3 parts molybdenum; 1 part vanadium; 0.05 parts zirconium; 0.015 parts boron; 0.1 parts carbon and the remainder nickel.

A ring structure formed of machined tool steel and low pressure plasma deposited alloy IN100 was tested by placing two half disks within the ring and applying tensile force to pull the half disks apart. The ring withstood tensile pull to about 170 ksi and then failed.

Although only one portion of the ring is described, it will be understood that the entire ring has been machined to form teeth such as 16, 18 and 20 and that these teeth are typical and illustrative of the ring of teeth formed by machining. Also, the filling of the troughs 17, 19 and 21 is illustrative of the filling of all of the troughs between all of the teeth of the ring. Further, the deposit 22, 24 and 26 over the external surface of the teeth is typical and illustrative of the filling out of the ring by low pressure plasma deposition process.

The composite billet has the general form illustrated in FIG. 3.

Figure 4:
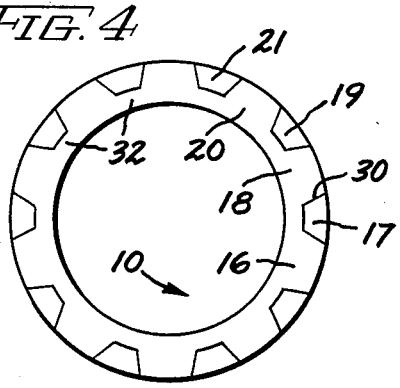
FIG. 4 is the ring of FIG. 3 from which the excess of plasma deposited material has been machined.

The next step in the preparation is described with reference to FIG. 4. The step involves the removal by machining or other suitable means of the excess material from the outer surface of the ring. This includes the excess deposit of plasma sprayed material. Such material is illustrated by the overlayers 22, 24 and 26 of FIG. 3. In addition, a small depth of the external surface of the teeth of the ring is removed to expose the outer surfaces of the teeth such as 16, 18 and 20. The paramagnetic material, such as 17, 19 and 21, which fills the space between the teeth of the ring remains intact and forms part of the ring structure from which the external excess material has been machined.

One facet of forming the ring structure of the present invention is the formation of a very strong bond at the surface which provides the interface between a tooth such as 16 or 18 and the deposited non-magnetic material in the troughs between the teeth such as 17 and 19. A typical interface, which is here designated as 30, is at the surface between the tooth 18 and the trough 17. It is very important to the survival of the ring structure as a ring structure that this interface be characterized by an extremely strong bond between the strong highly magnetic steel of the tooth 18 and the non-magnetic material of the trough segment 17. This same highly effective and strong interface and bond must exist at each interface of the ring and the description given above is of an interface 30 which is intended to be typical of the interfaces of the ring in as much as the failure of any one interface causes the failure of the entire ring when it is subjected to the very high stress generated during the rotation of the ring. This stress is indicated above to be about 130 ksi.

Figure 5:
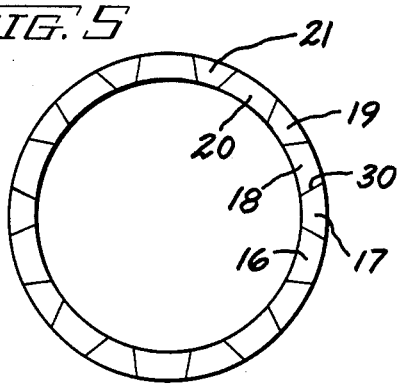
FIG. 5 is the ring of FIG. 4 from which the excess internal material has been machined.

After the excess external material is removed by machining or similar means, the ring structure is then given its final dimensions and shape by the removal of the excess internal material of the ring. This excess internal material is the inner layer as 32 of the ring 10. This inner layer 32 forms the connecting link between the teeth of the ring before the plasma deposited material is in place to serve as segments which hold the magnetic teeth together and in place. Removal of the inner layer of material 32 results in the formation of the ring structure as illustrated in FIG. 5. In this figure, the teeth 16, 18 and 20 are seen to be no longer teeth of a ring. Rather they are now segments of the ring in as much as the inner material 32 from which the teeth 16, 18 and 20 projected has been removed from the structure. Also, the material 17, 19 and 21 as representative of all similar paramagnetic segments of the ring are seen to now constitute the sole means by which the segments 16, 18 and 20 are held in place and together. This holding together is the result of the very strong bond formed typically at an interface typified by interface 30 between segment 17 and segment 18.

Again, the segments enumerated and the interface between the segments is given as illustrative of the entire ring of segments of the structure and of the interface between the adjacent segments of the structure.

It has been found that the low pressure plasma deposition as employed to form the structure illustrated in FIG. 3 yields a desirable product if a single plasma deposition gun is employed to deposit the sprayed material. However, it has also been found that a distinctly improved product is formed through the use of two plasma deposition guns directed at different angles to the surface such as the external surface illustrated in FIG. 2 when the deposit of the material is started. Prior to the deposit of the material. The surface of the machined ring as illustrated in FIG. 2 is cleaned by a transferred arc cleaning. The transferred arc cleaning is a cleaning process which is known in the low pressure plasma deposition art. It involves the generation of a plasma arc and the directing of the arc against the surface to be cleaned and the impressing of a voltage between the plasma gun and the workpiece such as the article of FIG. 2 which is to be cleaned and which is later to be the surface on which the plasma spray deposition is to be made.

The present inventors have found that there is an improved transferred arc cleaning which occurs when two plasma guns are used simultaneously and are directed nearly normal to the surface at two different locations on the external surface of the ring 10.

Figure 6:
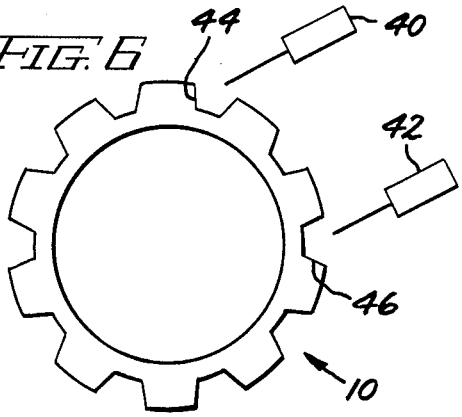
FIG. 6 is the ring of FIG. 2 under treatment by two plasma guns.

This may be illustrated by reference to FIG. 6 which illustrates the ring such as is provided in FIG. 2 but which also illustrates the placement and the orientation of the two plasma guns 40 and 42. The figure makes it clear that the gun 40 has its arc plasma directed in an alignment which brings it into contact with the interface surface 44 whereas the gun 42 is aligned to bring the arc plasma from the gun into contact with the interface 46 of the ring. It will be observed that the interface 44 is on one side of a trough and the interface 46 is on the opposite side of a different trough so that as the ring is rotated past the two plasma guns, each of the interface surfaces will receive the direct cleaning action of the transferred arc emanating from two respective guns 40 and 42.

The present inventors were surprised by the fact that the product formed with the use of two plasma deposition guns is improved over that formed with a single gun. However, after the fact, the inventors are led to the belief that the use of the two guns allows for a more favorable angle of deposition of the plasma deposited material at the side wall of the teeth as this is the location where good bond strength between the teeth and the deposited material is required.

Also, the inventors are led to the belief that the use of the two guns enhances the transferred arc cleaning of the sides of the teeth and thus helps to remove any residual oxides just prior to deposition of the plasma deposited material on the side surfaces of the teeth. It will be understood that it is at these surfaces at the sides of the teeth that the interface of the eventual composite structure are formed. We have observed that, by using two guns in connection with the structure as illustrated in FIG. 6, the surfaces are cleaned more completely by the transferred arc cleaning process than when a single plasma gun is employed.

The use of low pressure plasma spray deposition process also makes possible additional advantages which relate to the surface composition. Thus, the plasma spray deposition process permits a gradation of composition at the surface which eventually forms the interface between the alternating ferromagnetic and paramagnetic segments. A graded interface is significant in that it permits the material in immediate contact with the highly magnetic steel to have one composition and the adjoining material more remote from the steel to have a different composition which is not compatible with the steel surface. In this way, it is possible to eliminate interface carbides that may form when carbon from the ferromagnetic material diffuses into a paramagnetic material such as a superalloy paramagnetic material. Such an interface carbide layer may be a layer of a refractory metal carbide such as tungsten, tantalum or molybdenum carbides.

By contrast a graded interface might consist of elements which do not form carbide phases, such as nickel or cobalt, or alloys of these elements with small amounts (less than 10 weight %) of aluminum for strengthening of the interface layers.

It is expected that the novel process of the present invention will significantly reduce the cost of fabricating segmented shrink rings over the cost of preparing such rings by prior art processes. One way in which costs can be improved is by forming a number of individual rings as illustrated in FIG. 2 and by then placing them side by side in a plasma deposition process so that each of the rings receives a plasma deposition process so that each of the rings receives a plasma deposit to form a structure such as illustrated in FIG. 3. The plasma deposition of multiple rings in a single operation permits costs reduction. The rings are then separated after heat treatment.

Rings having alternating ferromagnetic and paramagnetic segments formed as described herein are used to hold wedges of alternating permanent magnets and filler materials. Such wedge containing rings are used in high speed permanent magnet generators for power systems for aircraft and other vehicles.

Segmented rings of other materials can also be prepared by the method of the present invention and have alternative uses based on their material content and construction.

What is claimed and sought to be protected by Letters Patent of the United States is as follows:

1. A method of forming a metal ring structure of alternating segments of two different metal materials, which comprises providing a ring of a first metal material having teeth, plasma arc cleaning the outer surface of said ring to prepare the outer surface for plasma deposition of a second metal material, plasma spray depositing said second metal material on the outer surface of said ring to fill in the troughs between the teeth, enlarging the inner diameter of the ring by removing the material to form a ring having alternating segments of said first metal and said second metal materials.

2. The method of claim 1 wherein the toothed outer surface is formed by removal of segments of said first material from the outer perimeter of the ring.

3. The method of claim 1 wherein said first material is ferromagnetic and said second material is paramagnetic.

4. The method of claim 1 wherein the second metal is a superalloy.

5. The method of claim 1 wherein the first metal is separated from the second metal by a graded interface.

6. The method of claim 1 wherein the first material is first coated with an interface layer of a metal which does not form a carbide before bulk deposit of the second material, such a layer being composed of superalloy which forms carbides which weaken the ring structure.

* * * * *